United States Patent [19]

van Heuvelen

[11] Patent Number: 4,556,610

[45] Date of Patent: Dec. 3, 1985

[54] FLEXIBLE GRAVURE SLEEVE

[75] Inventor: Jan H. van Heuvelen, Losser, Netherlands

[73] Assignee: Twentse Graveerindustrie B.V., Enschede, Netherlands

[21] Appl. No.: 484,869

[22] Filed: Apr. 14, 1983

[30] Foreign Application Priority Data

Apr. 16, 1982 [NL] Netherlands ..... 8201600

[51] Int. Cl.[4] ..... B41F 9/00; B41F 13/08

[52] U.S. Cl. ..... 428/666; 428/675; 428/926; 428/935; 101/153; 101/459

[58] Field of Search ..... 101/375, 401.1, 409, 101/328, 150, 153, 459; 29/132; 428/585, 586, 595, 610, 637, 675, 680, 666, 926, 935

[56] References Cited

U.S. PATENT DOCUMENTS

| | | | |
|---|---|---|---|
| 3,478,684 | 11/1969 | Schafler et al. | 428/637 |
| 3,753,664 | 8/1973 | Klingenmaier et al. | 428/935 |
| 4,405,709 | 9/1983 | Katano et al. | 101/401.1 |

FOREIGN PATENT DOCUMENTS

| | | | |
|---|---|---|---|
| 0053791 | 6/1982 | European Pat. Off. | 101/375 |
| 54-119344 | 9/1979 | Japan | 428/935 |
| 56-62193 | 5/1981 | Japan | 101/401.1 |
| 7807649 | 2/1979 | Netherlands | 101/375 |
| 416261 | 9/1934 | United Kingdom | 101/375 |
| 2031801 | 4/1980 | United Kingdom | 101/375 |

OTHER PUBLICATIONS

Schneider, R., et al; "Internal Stresses in Copper Single-Crystal Electrodeposits"; *Plating*, pp. 1063–1066.

*Primary Examiner*—L. Dewayne Rutledge
*Assistant Examiner*—John J. Zimmerman
*Attorney, Agent, or Firm*—Kenyon & Kenyon

[57] ABSTRACT

A flexible thinwalled sleeve for gravure printing is provided, which, going from inside to outside, essentially consists of (1) a slightly conical layer of nickel to provide mechanical strength, (2) a layer of copper, having the structure of high-gloss copper and which is essentially free of internal stresses, said layer having a cylindrical outer surface, (3) a thin, cylindrical layer of hard copper having a structure suitable for electronic engraving and having a gravure pattern on its outer surface, and if desired, (4) a thin protective layer of chrome.

These layers are all firmly adhered to each other and especially the two layers of copper cannot be separated by peeling off. Since a high-gloss copper layer, which is free of internal stresses, has been found unsuitable for electronic engraving, and since the layer of hard copper, suitable for electronic engraving, has been found to have internal stresses, which would be unacceptable in the first layer of copper, the two layers must necessarily be different.

5 Claims, No Drawings

FLEXIBLE GRAVURE SLEEVE

The invention relates to a flexible gravure sleeve having a cylindrical outer surface and a slightly conical inner surface.

The oldest and still most conventional form of gravure cylinders consists of a solid steel roller or a thick-walled rigid steel tube which, on the active part of its cylindrical surface, is provided with a layer of copper in which an, often screened, gravure pattern has been formed by etching. If desired, a protective layer of chrome may also be present.

In this respect many variations have already been proposed. In one of them there is passivated on the layer of copper, and on the first copper layer which properly adheres to the steel base there is electrodeposited a second, non-adhering layer (a so-called Ballard layer) which carries the gravure pattern. When this pattern has worn off or is no longer necessary, the second layer can be stripped off and replaced by a fresh one so that it is no longer necessary to unwind the cylinder in order to remove the gravure pattern.

The two above-mentioned forms have one great disadvantage in common: they are very heavy and difficult to manage and transport. Because the etching and printing often occur in widely separated places, this transport involves considerable cost. Moreover, the storage of used cylinders until they are used again is inconvenient due to their high weight and often considerable sizes. For this reason it has already been proposed to compose the cylinders of two parts, namely, a slightly conical core and a rigid sleeve having a slightly conical inner surface and a cylindrical outer surface, which sleeve fits over said core. The sleeve carries the gravure pattern and only this sleeve needs to be replaced for printing another pattern. In order to provide the sleeve with a new pattern, only this sleeve needs to be transported to the engraving machine. This ensures easier manageability and lower cost of transportation. According to the majority of these proposals the sleeve still consisted of a relatively thick-walled and rigid steel tube. These methods have never been used on an extensive scale.

Dutch patent application No. 7807649, which is a prior publication, proposes to produce flexible gravure sleeves by electrolysis. In this process a steel master roller, the form and sizes of which correspond to the desired internal sizes of the sleeve is first nickeled and then passivated.

On the thus obtained master roller there is first electrodeposited a layer of nickel having a thickness of 50–500 microns which is to impart the mechanical strength and elasticity to the final sleeve. Since the master sleeve is passivated this deposited nickel will not adhere to the master roller. By adding to the bath a known additive, e.g., saccharine, an internal compressive stress is produced in the deposited nickel.

After the nickel has been deposited in the desired thickness, the roller is removed from the bath and rinsed. The deposited layer of nickel may be allowed to start from the master roller, e.g., by inserting a little knife between the nickel and the master roller, after which the nickel sleeve can be slipped off the roller. This loosening may also be effected at a later stage.

Subsequently, the sleeve may be slipped over the same or another roller and provided with a layer of high-gloss copper having the desired thickness.

In order to obtain a proper adhesion of the copper to the nickel, there is first applied, in a known manner, a properly adhering, very thin layer of copper, preferably from a cyanide bath, after which there is first further copperplated in a conventional acidic copper bath to obtain the desired copper thickness, e.g., 125 microns. In this layer there may be produced a gravure pattern by etching and finally, if desired, the whole may be provided with a protective layer of chrome. In the above-mentioned patent application it further says:

> "In order to print with these sleeves, different methods may be followed. The most simple method is to slip the roller over a slightly conical core, which forms a permanent part of the printing press and confine the roller on said core with known means. In that case it is necessary that the inner wall of the roller should have a correspondingly conical form which may be obtained by using a slightly conical master roller having the same top angle as the core finally used. Then, after the copper plating, the exterior of the sleeve is of course also slightly conical and in that case the excess of copper may be removed by turning off the sleeve along with the master roller on a lathe to obtain a cylinder having the desired diameter. Because after this turning off there should, in every place, remain sufficient copper for enabling the etching, it will accordingly be necessary to deposit more copper. Therefore, it is recommendable to keep the difference in diameter between the two ends of the master roller as small as possible; for example, for a master roller having a diameter of 20 cm and a length of 2 m a difference in diameter of 500 microns is already sufficient".

While formerly the only manner of forming the gravure pattern in copper consisted in etching the layer of copper, a few years ago there was marketed equipment for electronic engraving in which a digitally operated chisel provides in the copper screen dots having a variable extension and depth. As compared with etching, this electronic engraving has the great advantages of an excellent reproducibility and a high reliability of operation resulting therefrom. However, this method is subject to limitations.

While etching of copper is always possible with about the same results, irrespective of how the etched layer of copper has been formed and independent on the hardness thereof and on its other physical properties, this is not the case with electronic engraving.

For successful electronic engraving it is necessary that the physical properties of the copper to be engraved should meet specific conditions. It is advisable that the structure of the copper to be engraved should be such that material can be removed with a minimum consumption of energy. Because this material removing energy cannot be measured in a non-destructive measure, there has been searched for a correlation between this magnitude and a magnitude which can indeed be measured in a non-destructive manner. In most cases there appeared to be a correlation between the desired physical properties and the hardness of the copper, at least in the group of hardening additives hitherto employed in copper baths for obtaining good engraving results. The most favourable conditions for engraving thereby appeared to occur at a Vickers hardness of 180–190 VPN.

The object of the invention is to further develop the electrolytically formed gravure sleeves according to Dutch patent application No. 7807649 in order to make them suitable for electronic engraving and, at the same time, make them suitable for use on a slightly conical core.

This has appeared to give unexpected difficulties. Due regard must be paid to the very thin and flexible layer of nickel which imparts the mechanical strength to the sleeve and is very elastic. Consequently, on the one hand, the copper layer should be such that the nickel layer is not deformed and, on the other hand, the copper layer should be suitable for electronic engraving.

In the art of electroplating methods have been known for depositing layers of copper having desired properties, such as different hardness, gloss etc.

When for copperplating a conventional acidic bath is used for high-gloss copperplating, it appears that a firmly adhering layer of copper having a proper gloss can be obtained. Shortly after the electrolytic copperplating, this layer has a Vickers hardness of more than 170 VPN, e.g., 200 VPN, but this layer does not appear to be suitable for electronic engraving. It is known that in such copper changes of structure very rapidly occur which are measurable in the change of the hardness of this copper which, e.g., after 24 hours at room temperature, is only about 120 VPN, and then such copper is no longer suitable for electronic engraving to obtain an acceptable gravure pattern. This change of structure along with a reduction of hardness proceeds more rapidly at elevated temperature so that at 100° C. the hardness has often decreased to about 120 VPN already after 10 minutes.

When for copper plating there is used another, likewise conventional acidic copper bath containing a known hardening additive, it appears that there can also be obtained a layer of copper which firmly adheres to the nickel and likewise has a hardness of 200 VPN or slightly more. This copper layer, however, retains its hardness during storage, at least for some months and perhaps much longer.

Yet such a copper layer, too, is not useful as the only copper layer in the presently contemplated gravure sleeves having a slightly conical inner surface and a cylindrical outer surface.

It has actually been found that such a copper layer has the desired hardness and engraving capacity indeed, but that this layer also shows a great internal tensile stress so that this layer tends to deform the inner nickel layer. This is the more serious so as in the ready sleeve the copper layer is relatively thin at the wide end of the nickel sleeve and considerably thicker at the narrow end of the nickel sleeve. This results in that the deformation, too, (with reduction of the diameter) is different at both ends so that the ready sleeve no longer fits over the conical core for which it was destined.

Hitherto no copper bath has been known which provides a layer of copper having the hardness and the allied physical properties required for electronic engraving and, at the same time, internal stresses that are low enough to prevent objectionable deformation of the nickel sleeve.

It should be noted that no data have so far been published regarding the occurrence of tensile stresses and/or compression stresses in copper layers that had been electrodeposited from different copper baths.

It has now been found that in high-gloss baths without hardening additives of the above-mentioned type an only low compression stress occurs in the deposited copper, usually of the order of 0–200 kg/mm$^2$ and that this hardly changes while the hardness of the copper decreases to about 120 VPN.

Moreover, it has appeared that the internal stress, e.g., by a dosed addition of polish or by a maintained proper selection of the working conditions, can be rather simply within the desired limits. A thus deposited copper layer will effect no appreciable deformation of the nickel sleeve and a variable thickness of such a copper layer is therefore not inconvenient.

If, however, a copper bath is used which does contain a hardening additive, it appears that the deposited copper has a high tensile stress (up to 7000 kg/mm$^2$ or more) so that such a copper layer is allowable in the ready sleeve only at a slight layer thickness (in order to keep the total deformation slight) and in particular at a layer thickness which is practically equal over the entire length of the sleeve (so that the unavoidable deformation is uniformly distributed over the entire length of the sleeve).

The invention therefore provides a flexible gravure sleeve having a cylindrical outer surface and a slightly conical inner surface, which sleeve, going from the inside to the outside, consists essentially of (a) a layer of nickel having a uniform thickness of 50–500 microns,
(b) an intermediate layer of copper firmly adhered thereto and having a slightly conical inner surface and a cylindrical outer surface,
(c) an outer layer of copper carrying a gravure pattern, and
(d) if desired, a layer of chrome having a thickness of 3–25 microns, which gravure sleeve is characterized in that the intermediate layer of copper is practically free of internal stresses and has a Vickers hardness of at most 130 VPN and in that the outer layer of copper is firmly adhered to the intermediate layer and has a Vickers hardness of at least 150 VPN and a thickness of 30–100 microns.

Indeed, also the above-mentioned older Dutch patent application No. 7807649 relates to a gravure sleeve containing on the first layer of copper a non-adhering and strippable layer (a so-called Ballard layer), but the present invention differs therefrom in that now the outer layer of copper is firmly adhered to the intermediate layer and further in that it is now required that the two layers differ in physical properties to avoid deformation of the nickel sleeve and, at the same time, enable electronic engraving. In the older application it was required for the Ballard layer that it did not adhere to the intermediate layer and no reference is made therein to differences in properties between the two layers of copper. For etching layer such a difference would be useless indeed. While a Ballard layer can only be stripped off by completely destroying the layer, the sleeve according to the invention can readily be slipped off the conical mandrel and slipped over it again and further used.

In electronic engraving screen dots are cut out down to a maximum depth which usually does not exceed 50 microns. The thickness of the hard outer copper layer is preferably such that the cut-away portions do not reach as far as the inner softer copper layer.

In order to apply the gravure sleeves according to the invention, there is used a steel core having a length which is at least equal to the length of the sleeve and which is slightly conical so that the core precisely fits in the sleeve. In order to secure the sleeve to the core, any method may be used in principle. The preferably used method is as follows:

The core is provided with an axial bore which, from one end, reaches as far as near the middle.

Furthermore, the core is provided with a compressed-air supply at the end of this axial bore and with a plurality of smaller bores which, from the surface of the core, reach into the axial bore.

First, the sleeve is slipped over the core as far as possible. Then compressed air is supplied into the axial bore under a pressure of, e.g., 4 atmospheres. This air flows through the axial bore and the smaller bores as far as between the mandrel and the sleeve so that the sleeve is expanded under the influence of the air pressure. The layer of nickel is strong and elastic enough to endure this expansion without damage. In the expanded state the sleeve can be further slipped over the core and brought accurately into the desired position, e.g. as far as a mark provided on the core. Then the air pressure is reduced and the elastic sleeve shrinks and then grips tightly around the core. In this state the core along with the sleeve secured thereto can be used for printing. In order to remove the sleeve from the core the same steps may be simply carried out in reverse order. It appears that the copper layers are not damaged by the expansion and springing back as stated before.

In the following example the manufacture of a sleeve according to the invention is described in detail.

EXAMPLE

Of a nickeled conical master roller having a length of 200 cm, a diameter of 155 mm at one end and a diameter of 154.50 mm at the other end, the nickeled surface was defatted and then passivated with a solution of 20 g/l of sodium dichromate.

Subsequently, there was electrodeposited on the surface at 63° C. and at 10 A/dm$^2$ a layer of nickel from a bath containing per liter:

| | |
|---|---|
| 450 g | nickel sulfamate |
| 40 g | boric acid |
| 8 mg | m-benzene disulfonic acid sodium salt |

The thickness of the deposited layer of nickel was 0.2 mm. As the roller was passivated, this layer did not adhere to the roller. Due to the presence of the last-mentioned component in the bath the deposited layer was under compressive stress. By inserting a little knife between the layer of nickel and the master roller the layer of nickel started and could be slipped off the roller at the thin end.

As the sleeve had been expanded by the relaxation of the compressive stress, the diameter had become greater than that of the roller by 0.06 mm.

This sleeve was slipped over a conical mandrel which in the middle was provided with 4 radial bores of 3 mm $\phi$, from which compressed air flowed, which was supplied from one end of the mandrel through an axial bore. The length of the mandrel was 200 cm and the diameter at one end 155.10 mm and at the other end 154.60 mm. Due to the pressure of the compressed air (4 atmospheres) the nickel sleeve was slightly stretched so that it could be readily slipped over the mandrel, although the diameter thereof was slightly larger than the internal diameter of the sleeve. After the supply of compressed air had been closed down, the nickel sleeve shrank and gripped tightly around the mandrel.

The sleeve was then defatted electrolytically, activated with 18% HCl solution, rinsed and provided in a cyanide copper bath with a layer of copper having a thickness of 5 microns. Then the mandrel was removed from the copper bath, rinsed, activated with 10% sulphuric acid solution and copperplated in a high-gloss bath to obtain a layer thickness of 0.4 mm copper.

This copper bath contained per liter:

| | |
|---|---|
| 200 g | copper sulfate |
| 60 g | sulphuric acid |
| 50 mg | chloride and |
| 2 ml | RG 10 (a polisher marketed by Lea Ronal, Buxton, England). |

The hardness of the copper measured immediately after copperplating was 210 VPN. After 24 hours at 20° C. it had decreased to 120 VPN. In another test it appeared that this decrease of the hardness can also be obtained by storing for 10 min. at 100° C.

Instead of RG 10 there may also be used, with practically the same results, the product Ubac marketed by Oxy Metal Finishing, 's-Hertogenbosch or the product Isobrite-Cuflex, marketed by Messrs. Richardson, Des Plaines, Ill., USA.

The remainders left after this decrease of hardness appeared to cause no difficulties in the further processing.

After the decrease of hardness the whole mandrel was placed in a lathe and the sleeve was turned off so that a purely cylindrical outer surface was obtained.

After again defatting and activating there was deposited at 27° C. and 15 A/dm$^2$ on the turned-off copper layer a second copper layer having a thickness of 0.1 mm and a hardness suitable for electronic engraving.

The copper bath employed contained per liter:

| | |
|---|---|
| 200 g | copper sulfate |
| 60 g | sulphuric acid |
| 0.6 ml | "Helioflex" (a hardening additive, supplied by M & T Chemicals, Vlissingen, Holland). |

Instead of the Helioflex there may also be used other commercially available hardening additives, e.g., "Veccu" supplied by Martin (Switzerland), "Rolli" by Standard Process Corporation, Chicago, or hardening additives marketed by Merck, Darmstadt.

Immediately after copperplating there was measured a hardness of the deposited layer of 185 VPN. Also after some weeks this value had not changed.

This hard copper layer was polished and provided with a gravure pattern by means of an electronic engraving machine (supplied by Messrs. Hell). After engraving the mandrel with the sleeve was provided in a chrome bath with a chrome layer having a thickness of 7 microns and polished to obtain a high-gloss surface.

In order to loosen the thus obtained sleeve from the mandrel, compressed air was supplied to the axial bore (7 atmospheres) so that the entire sleeve (nickel, all copper layers and chrome) was stretched to such an extent that the whole could be slipped off the mandrel. In doing so, the yield strength was not exceeded.

Subsequently, the sleeve, again with the aid of compressed air, was slipped over another mandrel having the same sizes, the axle journals of which fitted in a printing press. The sleeve thus mounted on the mandrel could then be used as if it were a solid gravure cylinder.

During the printing process no difference was noticed between a conventional gravure roller and the sleeve on the mandrel as produced according to this example.

What I claim:

1. A flexible gravure sleeve having a cylindrical outer surface and slightly conical inner surface, the sleeve having a small internal diameter end and a large internal diameter end, which sleeve, going from the inside to the outside, comprises (a) a layer of nickel having a uniform thickness of 50–500 microns, (b) an intermediate layer of copper nonstrippably adhered to the nickel layer, said intermediate layer having a Vickers hardness of not more than 130 VPN and having a slightly conical inner surface and a cylindrical outer surface, the intermediate layer of copper comprising a thin uniform adhesive layer deposited directly on the nickel layer and a layer of copper deposited on the adhesive layer and containing a polisher, and (c) an outer layer of copper carrying a gravure pattern, the outer layer of copper being nonstrippably adhered to the intermediate layer and having a Vickers hardness of at least 150 VPN and a thickness of 30–100 microns.

2. A flexible gravure sleeve according to claim 1, wherein the inside diameter of the nickel layer at the large internal diameter end of the sleeve is 50–500 microns larger than that at the small internal diameter end, calculated per meter length of the sleeve.

3. A flexible gravure sleeve according to claim 1, wherein the sleeve further comprises a layer of chrome having a thickness of 3–25 microns, the layer of chrome being deposited on the outer layer of copper carrying the gravure pattern.

4. A flexible gravure sleeve having a cylindrical outer surface and a slightly conical inner surface, the sleeve having a small internal diameter end and a large internal diameter end, which sleeve, going from the inside to the outside, comprises (a) a layer of nickel having a uniform thickness of 50–500 microns, (b) an intermediate layer of copper nonstrippably adhered to the nickel layer, said intermediate layer having a Vickers hardness of not more than 130 VPN, being practically free of internal stresses, and having a slightly conical inner surface and a cylindrical outer surface, and (c) an outer layer of copper carrying a gravure pattern, the outer layer of copper being nonstrippably adhered to the intermediate layer and having a Vickers hardness of at least 150 VPN and a thickness of 30–100 microns.

5. A flexible gravure sleeve having a cylindrical outer surface and slightly conical inner surface, the sleeve having a small internal diameter end and a large internal diameter end, which sleeve, going from the inside to the outside, comprises (a) a layer of nickel having a uniform thickness of 50–500 microns, (b) an intermediate layer of high-gloss copper nonstrippably adhered to the nickel layer, said intermediate layer having a Vickers hardness of not more than 130 VPN and having a slightly conical inner surface and a cylindrical outer surface, the intermediate layer of copper comprising a thin uniform adhesive layer deposited directly on the nickel layer from a cyanide copper bath and a layer of copper deposited on the adhesive layer and containing a polisher, and (c) an outer layer of copper carrying a gravure pattern, the outer layer of copper being nonstrippably adhered to the intermediate layer and having a Vickers hardness of at least 150 VPN and a thickness of 30–100 microns.

* * * * *

UNITED STATES PATENT AND TRADEMARK OFFICE

CERTIFICATE OF CORRECTION

PATENT NO. : 4,556,610

DATED : December 3, 1985

INVENTOR(S) : Jan H. Van Heuvelen

It is certified that error appears in the above-identified patent and that said Letters Patent is hereby corrected as shown below:

Column 1, line 16, after "layer" insert a comma.

Column 1, line 17, after "base" insert a comma.

Column 1, line 49, after "sleeve" insert a comma.

Column 1, line 55, after "passivated" insert a comma.

Column 2, line 31, change "recommendable" to --recommended--.

Column 2, line 34, after "2 m" insert a comma.

Column 2, line 49, change "independent on" to --independent of--.

Column 2, line 59, change "searched for" to --a search for--.

Column 3, line 15, after "electroplating" insert a comma.

Column 3, line 18, omit "for copperplating".

UNITED STATES PATENT AND TRADEMARK OFFICE

CERTIFICATE OF CORRECTION

PATENT NO. : 4,556,610

DATED : December 3, 1985

INVENTOR(S) : Jan H. Van Heuvelen

It is certified that error appears in the above-identified patent and that said Letters Patent is hereby corrected as shown below:

Column 3, line 25, after "copper" insert a comma.

Column 3, line 33, change "decreased to about 120 VPN already" to --already decreased to about 120 VPN--.

Column 3, line 52, between "serious" and "in", omit "so as" and insert --because--.

Column 3, line 55, change "This results in that" to --As a result,--.

Column 4, line 2, after "type" insert a comma.

Column 4, line 3, change "only" to --exclusively--.

Column 4, line 8 and Column 4, line 9, change "maintained proper selection of the working conditions, can be" to --proper selection of the working conditions, can be maintained--.

Column 4, line 56, between "For" and "etching", insert the word --the--.

UNITED STATES PATENT AND TRADEMARK OFFICE

CERTIFICATE OF CORRECTION

PATENT NO. : 4,556,610

DATED : December 3, 1985

INVENTOR(S) : Jan H. Van Heuvelen

It is certified that error appears in the above-identified patent and that said Letters Patent is hereby corrected as shown below:

Column 4, line 62, after "engraving" insert a comma.

Column 5, line 20, reverse the words "further slipped" to --slipped further--.

Column 5, line 52, after "bath" insert a comma.

Column 5, line 54, after "roller" insert a comma.

Column 6, line 6, after "provided" insert a comma.

Column 6, line 7, after "bath" insert a comma.

Column 6, line 60, after "provided" insert a comma.

Column 6, line 61, after "bath" insert a comma.

Signed and Sealed this

*Fifteenth* Day of *July 1986*

[SEAL]

*Attest:*

DONALD J. QUIGG

*Attesting Officer* *Commissioner of Patents and Trademarks*